United States Patent [19]

Entrikin

[11] 3,973,814

[45] Aug. 10, 1976

[54] DRAWER SLIDE ASSEMBLY FOR SELF-CLOSING DRAWER

[75] Inventor: Ronald K. Entrikin, Rockford, Ill.

[73] Assignee: Amerock Corporation, Rockford, Ill.

[22] Filed: June 4, 1975

[21] Appl. No.: 583,761

[52] U.S. Cl. ..... 312/333; 308/3.6; 308/3.8; 312/330 R; 312/348

[51] Int. Cl.[2] ..... A47B 88/04; F16C 21/00

[58] Field of Search ..... 312/333, 319, 330, 341, 312/343–349, 350; 211/162; 308/3.6, 3.8

[56] References Cited

UNITED STATES PATENTS

| | | | |
|---|---|---|---|
| 3,053,582 | 9/1962 | Wenger | 308/3.8 |
| 3,243,247 | 3/1966 | Knape | 312/333 |
| 3,697,140 | 10/1972 | Livingston | 308/3.8 |
| 3,744,869 | 7/1973 | Anderson | 312/330 |

*Primary Examiner*—Casmir A. Nunberg
*Attorney, Agent, or Firm*—Leydig, Voit, Osann, Mayer & Holt, Ltd.

[57] ABSTRACT

Tracks are secured to the sides of a drawer and ride along sets of front and rear rollers at the front of a cabinet to guide the drawer for back and forth sliding in the cabinet. Downwardly inclined ramps are formed intermediate the ends of the tracks and act upon the rear rollers to cause the drawer to pivot about the front rollers to close the drawer automatically. Horizontally spaced tabs integrally formed with each of the tracks adjacent opposite ends thereof are spaced from the lower edge of the track different distances. On each side panel of the drawer, the tabs telescope into a kerf formed in the side panel to aid in supporting the drawer on the rollers and to assure proper location of the track on the side panel so that the ramps are positioned properly to obtain the desired self-closing action.

2 Claims, 4 Drawing Figures

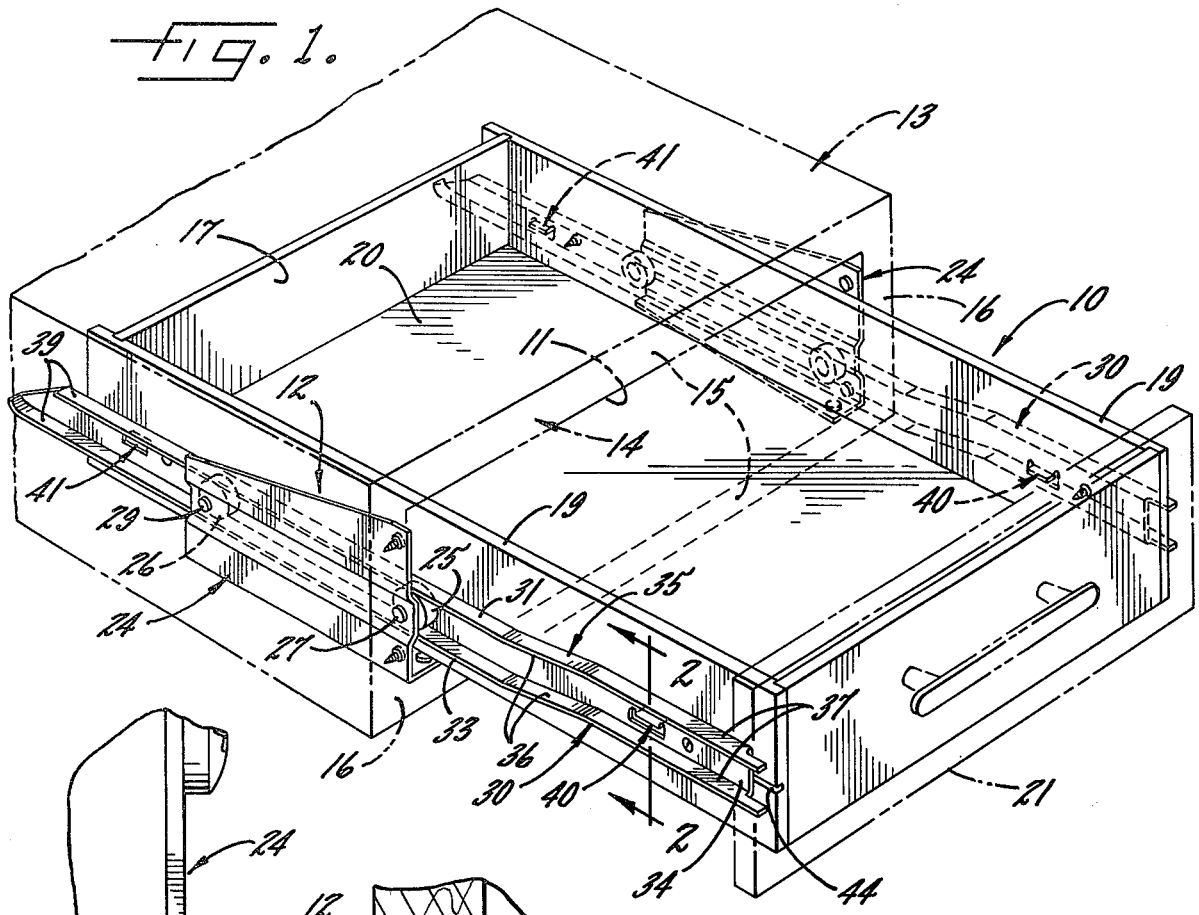
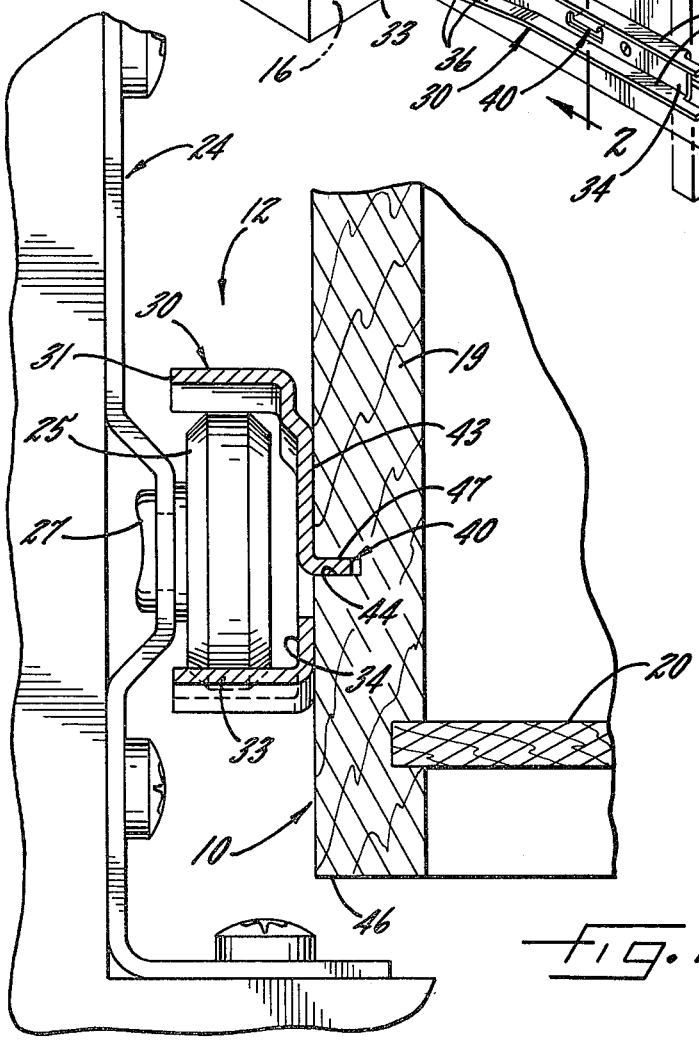
Fig. 2.

DRAWER SLIDE ASSEMBLY FOR SELF-CLOSING DRAWER

BACKGROUND OF THE INVENTION

This invention relates to a drawer slide assembly for supporting and guiding a drawer for back and forth sliding in an opening in a cabinet and, more particularly, to an assembly of the type which effects automatic closing of the drawer as the latter approaches its closed position and which also tends to hold the drawer in the closed position. In one assembly of the foregoing type, a front suspension assembly includes pairs of front and rear anti-friction rollers which are attached to the front of the cabinet adjacent the opening therein and ride within elongated tracks secured to opposite side panels of the drawer so as to guide movement of the drawer into and out of the cabinet. In particular, the tracks are each formed with so-called "down ramps" which act in conjunction with the weight of the drawer to cause self-closing of the drawer. To achieve the proper self-closing action for the drawer, the down ramps are located intermediate the ends of the tracks in such a position that the down ramps act on the rear guide rollers and cause the rear of the drawer to pivot downwardly about the front rollers as an incident to closing.

Drawer slide assemblies generally similar to the foregoing type are dislosed in U.S. Pat. Nos. 3,697,140 and 3,744,869.

SUMMARY OF THE INVENTION

The primary aim of the present invention is to provide a new and improved drawer assembly system of the foregoing general character which is adapted to facilitate easy assembly of the system in a cabinet and, particularly, the proper positioning of the down ramp on the side panel of the drawer so that the ramp is oriented properly to achieve the desired self-closing action provided by such assembly. More specifically, this is achieved through the provision of two spaced tabs integrally formed with each of the tracks and extending inwardly therefrom to mate with a horizontally opening kerf formed in the adjacent side panel of the drawer in a preselected position so as to locate the track with the ramp properly oriented to achieve the desired self-closing action.

The invention also resides in the novel positional relationship between the tabs of each track with the lower edge of such track so as to properly position the ramp on the side panel of the drawer and in the location of screw holes in the track so that the screws used to secure the track to the side of the drawer take advantage of the kerf as pilot holes.

These and other objects and advantages of the present invention will become more apparent from the following detailed description when taken in conjunction with the accompanying drawings.

BRIEF DESCRIPTION OF THE DRAWINGS

FIG. 1 is a fragmentary perspective view of a cabinet and a drawer equipped with a new and improved drawer slide assembly embodying the novel features of the present invention.

FIG. 2 is an enlarged, fragmentary, cross-sectional view taken substantially along ling 2—2 of FIG. 1.

Figure 3:
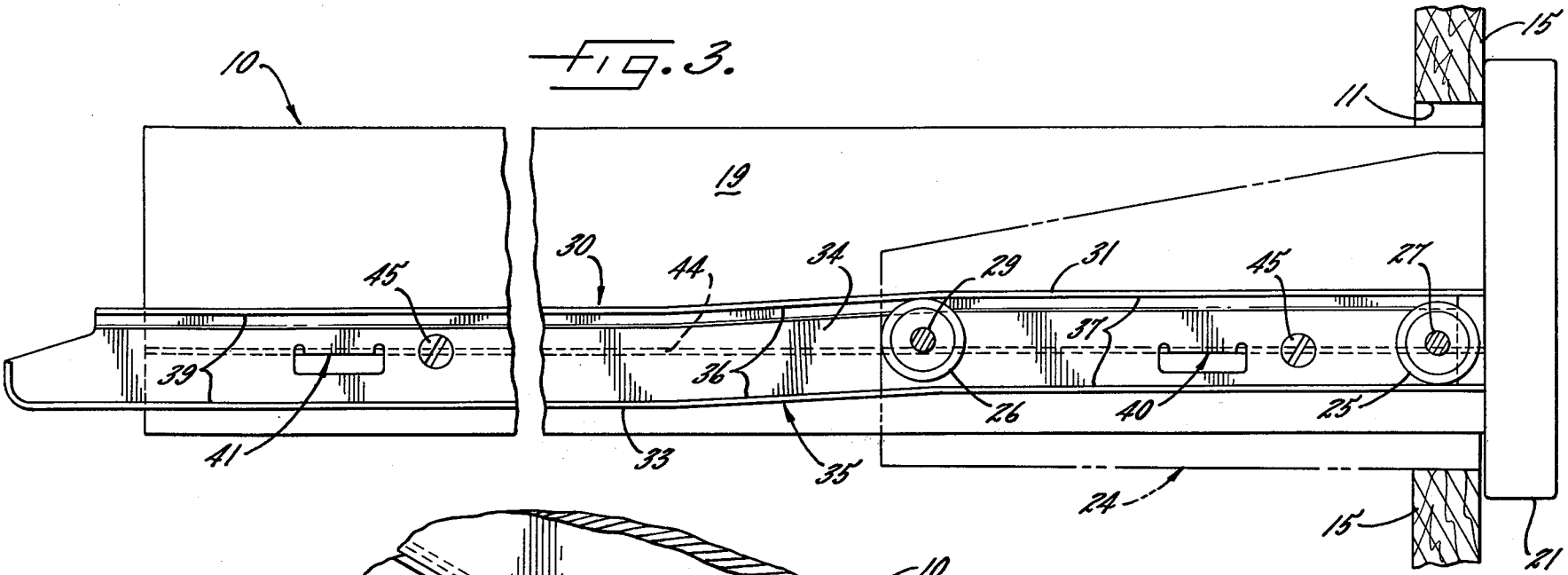
FIG. 3 is an enlarged vertical cross section taken longitudinally of the drawer and showing the latter in a closed position.
Figure 4:
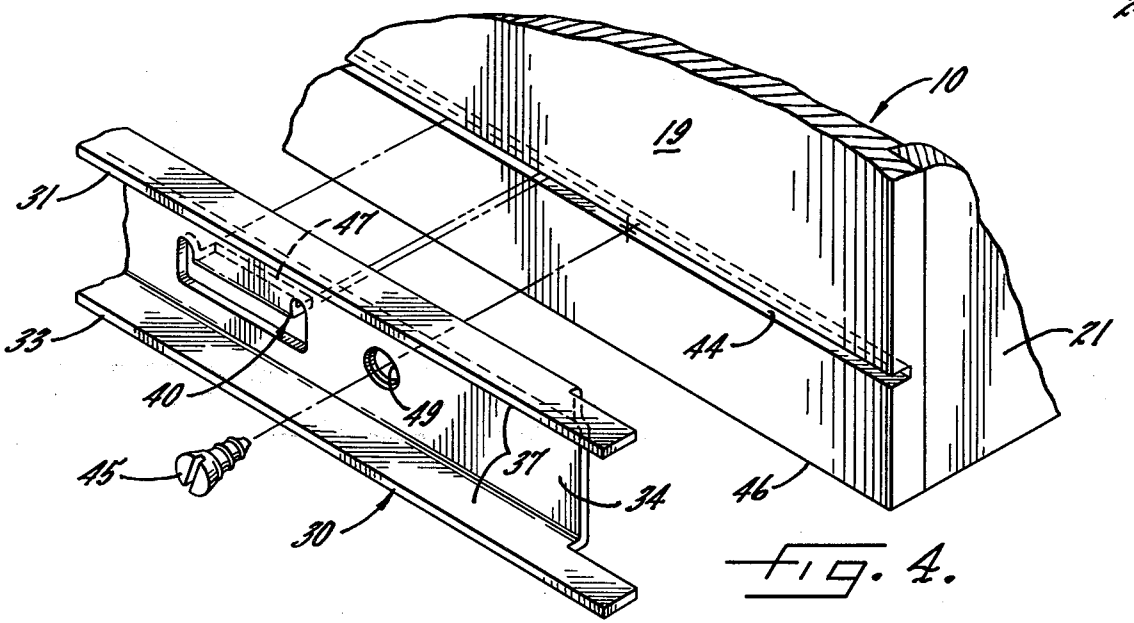
FIG. 4 is an enlarged, fragmentary, exploded perspective view of parts of the drawer slide assembly.

DETAILED DESCRIPTION OF THE PREFERRED EMBODIMENT Description of the Preferred Embodiment As shown in the drawings for purposes of illustration, the invention is embodied in a drawer slide assembly 12 particularly suited for use in a cabinet 13 to support a drawer 10 for back and forth sliding within an opening 11 in the cabinet, the opening being defined by a face frame 14 attached to the front of the cabinet and having top and bottom members 15 and opposed vertical side members 16. Herein, the drawer includes the usual rear, side, bottom and front panels 17, 19, 20 and 21, respectively, which may be formed of wood, pressed wood, fiber board or another suitable wood-like material and which are fitted together in a generally rectangular shape and fastened to each other such as by gluing.

To support the drawer 10 for back and forth sliding within the cabinet 13, brackets 24 are attached to the inner edges of the vertical face frame members 16 and each bracket carries thereon a pair of front and rear anti-friction rollers 25 and 26 journaled to turn about horizontal axles 27 and 29. Elongated tracks 30 are secured to the side panels 19 of the drawer and ride along the rollers as the drawer is moved back and forth. Each track is of outwardly opening U-shaped cross section and defines a channel within which the rollers fit, the track including upper and lower outwardly projecting flanges 31 and 33 (see FIGS. 1 and 2) connected together by an upright plate 34 and defining the upper and lower edges of the track. As shown in FIG. 3, the vertical spacing between the flanges is slightly greater than the diameter of the rollers so that the tracks may ride along the rollers without binding.

Each track 30 is formed with a downwardly inclined portion 35 (see FIGS. 1 and 3) commonly called a down ramp. The purpose of the down ramps 35 is to cause the drawer 10 to close automatically (i.e., to self close from a slightly open position) upon being pushed a predetermined distance into the cabinet 13 and also to retard free opening of the drawer so that the latter will tend to remain in its closed position. Acting in conjunction with the weight of the drawer and its contents, the down ramps cause the rear of the drawer to pivot downwardly as the drawer approaches its closed position and such pivoting enables gravity to move the drawer the remaining distance toward the closed position.

More specifically, each down ramp 35 herein is formed by downwardly and rearwardly inclining approximately 3-inch lengths of intermediate sections 36 (see FIG. 3) of the flanges 31 and 33 through an angle of slightly less than 2° from the horizontal so as to effect a drop of about three thirty-seconds inch from the front to the rear of the intermediate sections 36. The flanges also include front horizontal sections 37 which are disposed forwardly of the inclined intermediate sections 36 and rear horizontal sections 39 which are located rearwardly of the intermediate sections 36.

To achieve the desirable self-closing action with the exemplary drawer slide assembly 12, it is necessary to accurately locate each of the ramps 35 so that it slants downwardly from horizontal upon progressing rearwardly between the forward and rearward sections 37 and 39 of the two tracks 30. In accordance with the primary aspect of the present invention, forward and rearward tabs 40 and 41 projecting from the inside face 43 of the tracks 30 serve to substantially simplify the process of installing the tracks on the side panels 19 of the drawer with the ramps 35 oriented precisely for proper self-closing action. For these purposes, the rearward tab 41 is spaced upwardly from the lower edge or flange 33 of the track a distance substantially greater than the distance the forward tab 40 is spaced upwardly from such lower edge and both tabs extend away from the track at substantially right angles thereto. When installing the tracks on the side panels, each track is moved broadwise to telescope the tabs horizontally into slots 44 formed in the side panels and extending generally parallel to the bottom 20 of the drawer. Once in the slots, the tabs serve to support and locate the tracks on the side panels so that fasteners 45 may be used to secure the tracks to the panels without the tracks shifting vertically out of position so as to assure that the ramps are oriented properly to achieve the desired self-closing action with the assembly.

In the present instance, there are two of the slots 44, one being formed in each side panel 19 of the drawer 10. More particularly, each slot is defined by an elongated kerf 44 which is spaced upwardly from the lower edge 46 of the side panel and is cut in a perpendicular direction into the side panel to extend substantially parallel with the bottom 20 of the drawer and along the entire length of the panel. As shown in FIG. 2, the thickness of the kerf is approximately equal to the thickness of the tab and may be slightly larger to permit the tab to slide easily into the kerf. In addition, the depth of the kerf is somewhat greater than the distance the tab projects away from the inside face 43 of the track so as to assure that the face 43 abuts flat against the outside of the side panel 19. Advantageously, the kerfs may be cut easily and quickly in the side panels during the usual routing of the workpieces which are formed into the panels without any substantial lengthening of the time required to produce the side panels.

As shown in FIG. 3, the forward and rearward tabs 40 and 41 of each track 30 are spaced from the lower flange 33 of such track different distances so that, when the tabs are inserted into the kerf 44, the ramp 35 is positioned at the precise angle desired to achieve proper self-closing action with the drawer slide assembly 12. More particularly, each of the tabs is formed integrally with its associated track such as by being struck from the upright plate 34 to extend in a generally perpendicular direction opposite the flanges 31 and 33 and away from the plate. In addition, each tab is generally rectangular in shape, extending lengthwise generally parallel with the lower flange of the track so that, when inserted into the kerf 44, the upper face 47 of the tab abuts the upper wall of the kerf to provide a substantial portion of the vertical support of the drawer on the track. Additional support is provided by the fasteners 45 which, in the present instance, are in the form of suitable screws extending through holes 49 located in the track adjacent the tabs. Preferably, there are two such holes 49 and screws 45 for each track with the holes being located adjacent the tabs to align with the kerf in the side panel 19 when the track is placed on the panel. In this way, the kerf also serves as a pilot hole for the screws to be turned into the side panel to secure the track on the side panel.

From the foregoing, it will be appreciated that the present invention brings to the art a new and improved drawer slide assembly 12 which is particularly adapted for quick, easy and accurate mounting of the track 30 on a wood or wood-like drawer 10 so as to assure proper location and orientation of the down ramp 35 to achieve the self-closing action for the assembly. Advantageously, the track is provided with the tabs 40 and 41 located at different distances from the lower edge or flange 33 of the track so, when the tabs fit within the kerf 44, the track is located on the side panel with the ramp in its proper orientation.

I claim as my invention:

1. A self-closing drawer slide assembly supporting a drawer to slide between open and closed positions within an opening in a cabinet, said assembly comprising first and second brackets mounted within said cabinet adjacent the sides of said opening, front and rear rollers journaled on each of said brackets, first and second tracks secured to opposite sides of said drawer, said rollers engaging said tracks to support said drawer slidably within said cabinet, each of said tracks comprising substantially horizontal forward and rearward sections and an intermediate ramp section extending therebetween and being slanted downwardly at a preselected angle upon progressing rearwardly from said forward section toward said rearward section, elongated slots formed in and opening horizontally out of the sides of said drawer, said slots being spaced upwardly from and extending parallel with the bottom of said drawer, forward and rearward tabs integrally formed with said forward and rearward sections, respectively, and projecting horizontally therefrom into said slots to support said tracks vertically on said drawer, said rearward tab of each track being spaced upwardly from the lower edge of said rear section a distance greater than the distance said forward tab is spaced upwardly from the lower edge of said forward section but being located in the same horizontal plane as said forward tab when said track is secured to said drawer whereby said ramps are positioned precisely on the drawer so the drawer closes automatically from a slightly open position, and fasteners extending through said tracks and into the sides of the drawer to secure the tracks thereto.

2. A self-closing drawer slide assembly supporting a drawer with opposing side panels formed of a wood-like material to slide between open and closed positions within an opening in a cabinet, said assembly comprising first and second brackets mounted within said cabinet adjacent the sides of said opening, each bracket having front and rear rollers journaled thereon, a track secured to each of said opposing side panels, said rollers engaging said tracks to support said drawer slidably within said cabinet, said tracks each including a forward section, a rearward section, and an intermediate ramp section which slopes downwardly from said forward section upon progressing toward said rearward section, forward and rearward tabs struck from said forward and rearward sections, respectively, said tabs extending generally horizontally from said track with said rearward tab being spaced vertically from the lower edge of said track a distance greater than the vertical distance between said forward tab and said lower edge, an elongated horizontal kerf formed in and opening horizontally out of each of said side panels and extending generally parallel with the bottom of said drawer, each of said kerfs receiving the forward and rearward tabs of one of said tracks so as to support such track vertically on the drawer with said forward and rearward tabs located in the same horizontal plane and with said ramp precisely located on said drawer whereby the drawer closes automatically from a slightly open position, a hole formed horizontally through each track adjacent each of said tabs and alined with said kerf, and screws extending through said holes and into the kerfs and panels to secure the tracks to the drawer.

* * * * *